US011050186B2

(12) United States Patent
Toda

(10) Patent No.: US 11,050,186 B2
(45) Date of Patent: Jun. 29, 2021

(54) CONNECTION STRUCTURE, FORMING METHOD OF CONNECTION STRUCTURE AND CABLE OF CONNECTION STRUCTURE

(71) Applicant: JAPAN AVIATION ELECTRONICS INDUSTRY, LIMITED, Tokyo (JP)

(72) Inventor: Kentaro Toda, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/896,314

(22) Filed: Jun. 9, 2020

(65) Prior Publication Data

US 2021/0021081 A1 Jan. 21, 2021

(30) Foreign Application Priority Data

Jul. 16, 2019 (JP) ..... JP2019-131181

(51) Int. Cl.
*H01R 13/58* (2006.01)
*H01R 13/506* (2006.01)
*H01R 12/53* (2011.01)

(52) U.S. Cl.
CPC ..... *H01R 13/5812* (2013.01); *H01R 12/53* (2013.01); *H01R 13/506* (2013.01)

(58) Field of Classification Search
CPC ..... H01R 13/58; H01R 12/53; H01R 13/506
See application file for complete search history.

(56) References Cited

U.S. PATENT DOCUMENTS

| | | | | |
|---|---|---|---|---|
| 6,078,014 | A | 6/2000 | Kashiwazaki et al. | |
| 6,316,846 | B1 | 11/2001 | Kashiwazaki et al. | |
| 10,348,032 | B2 | 7/2019 | Yamaguchi et al. | |
| 2009/0277665 | A1* | 11/2009 | Kumamoto | H05K 1/0245 174/113 R |
| 2019/0393656 | A1* | 12/2019 | Wu | H01R 24/60 |

FOREIGN PATENT DOCUMENTS

| | | | | |
|---|---|---|---|---|
| JP | H04115419 | A | | 4/1992 |
| JP | H0536315 | A | | 2/1993 |
| JP | 11224540 | A | * | 8/1999 |
| JP | 2010027577 | A | | 2/2010 |
| JP | 2018152244 | A | | 9/2018 |
| WO | 9721235 | A1 | | 6/1997 |

* cited by examiner

*Primary Examiner* — Briggitte R. Hammond
(74) *Attorney, Agent, or Firm* — Holtz, Holtz & Volek PC

(57) ABSTRACT

A connection structure comprises a cable and a connection object. The cable includes two wires, two coverings and two coupling strips. The coverings cover the wires, respectively. Each of the coupling strips couples the two coverings to each other. The connection object comprises a base portion and a pressing member. The base portion has a catch portion and two side portions. The cable has a pressed section and a rear section located rearward of the pressing member in a front-rear direction (X-direction). The pressed section is sandwiched and pressed between the pressing member and the catch portion in an upper-lower direction (Z-direction) and is located between the two side portions in a lateral direction (Y-direction). In the lateral direction, a distance between the two wires of the pressed section is longer than another distance between the two wires of the rear section.

8 Claims, 6 Drawing Sheets

CONNECTION STRUCTURE, FORMING METHOD OF CONNECTION STRUCTURE AND CABLE OF CONNECTION STRUCTURE

CROSS REFERENCE TO RELATED APPLICATIONS

This application is based on and claims priority under 35 U.S.C. § 119 to Japanese Patent Application No. JP2019-131181 filed Jul. 16, 2019, the content of which is incorporated herein in its entirety by reference.

BACKGROUND OF THE INVENTION

This invention relates to a connection structure comprising a cable and a connection object.

For example, this type of connection structure is disclosed in JP2018-152244A (Patent Document 1), the content of which is incorporated herein by reference.

Referring to FIG. 11, Patent Document 1 discloses a connection structure 90 comprising a cable 92 and a connector (connection object) 94. The cable 92 includes a plurality of wires 922. The connection object 94 comprises a board 96 and a locator 98. The board 96 is formed with a plurality of electrodes 962 which correspond to the wires 922, respectively. The electrodes 962 are arranged in a pitch direction. The locator 98 is formed with a plurality of insertion holes 982 which correspond to the wires 922, respectively. The insertion holes 982 are arranged in the pitch direction. Each of the wires 922 is inserted into the corresponding insertion hole 982, so that the wires 922 are positioned in the pitch direction. Each of the thus-positioned wires 922 is connected to the corresponding electrode 962. As described above, the locator 98 positions the wires 922 in the pitch direction.

According to the existing technique, wires of a connection structure are positioned typically by using a locator such as that of Patent Document 1. However, the positioning of the wires with the use of the existing locator is a cumbersome work.

SUMMARY OF THE INVENTION

It is therefore an object of the present invention to provide a connection structure with a structure that enables easy positioning of wires.

An aspect of the present invention provides a connection structure comprising a cable and a connection object. The cable comprises two wires, two coverings, two coupling strips and a hollow. The coverings correspond to the wires, respectively. Each of the coverings covers a corresponding one of the wires. Each of the coupling strips couples the two coverings to each other in a cable cross-section perpendicular to an extending direction of the cable. The hollow is a space enclosed by the coverings and the coupling strips in the cable cross-section. The connection object comprises a base portion and a pressing member. The base portion has an attachment surface, a catch portion, two side portions and two pads. The side portions correspond to the coverings, respectively. The pads correspond to the wires, respectively. The catch portion is provided on the attachment surface and is located between the two side portions in a lateral direction. Each of the side portions extends to be away from the attachment surface in an upper-lower direction perpendicular to the lateral direction. Each of the pads is provided on the attachment surface and is located forward of the catch portion in a front-rear direction perpendicular to both the lateral direction and the upper-lower direction. The pressing member is attached to the base portion. The cable has a pressed section. The pressed section is sandwiched and pressed between the pressing member and the catch portion in the upper-lower direction and is located between the two side portions in the lateral direction. One of the coupling strips of the pressed section is in contact with the pressing member. A remaining one of the coupling strips of the pressed section is in contact with the catch portion. At least one of the coverings of the pressed section is in contact with a corresponding one of the side portions. Each of the wires has an exposed portion exposed from the covering. Each of the exposed portions is connected to a corresponding one of the pads. The cable has a rear section. The rear section is located rearward of the pressing member. In the lateral direction, a distance between the two wires of the pressed section is longer than another distance between the two wires of the rear section.

According to an aspect of the present invention, the two coverings of the cable cover the two wires, respectively, and enclose the hollow together with the two coupling strips in the cable cross section. According to this structure, the cable which extends along the front-rear direction can be resiliently deformed by a vertical pressure applied to the cable so that the two wires are away from each other in the lateral direction. In detail, when a part of the cable, namely the pressed section, is arranged between the two side portions and is resiliently deformed as described above, at least one of the coverings is pressed against the corresponding side portion. As a result, two wires can be positioned in the lateral direction. As described above, according to an aspect of the present invention, the wires can be positioned only by arranging the pressed section of the cable between the two side portions and by pressing the thus-arranged pressed section. Thus, an aspect of the present invention provides the connection structure with a structure that enables easy positioning of the wires.

An appreciation of the connection objectives of the present invention and a more complete understanding of its structure may be had by studying the following description of the preferred embodiment and by referring to the accompanying drawings.

Figure 1:
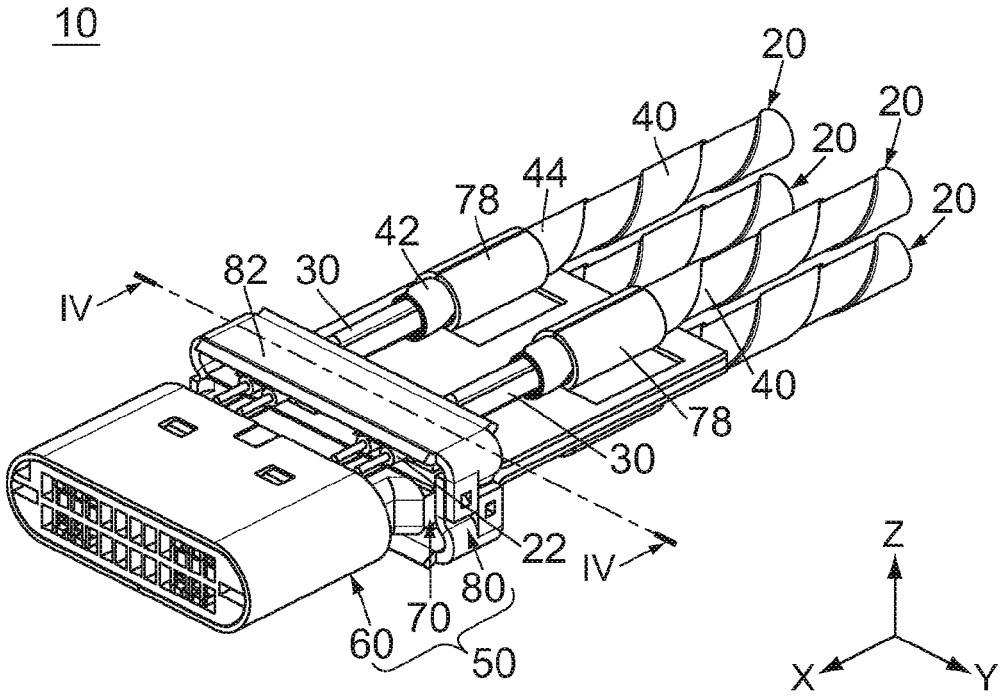
FIG. 1 is a perspective view showing a connection structure according to an embodiment of the present invention, wherein cables of the connection structure are connected to a connection object of the connection structure.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
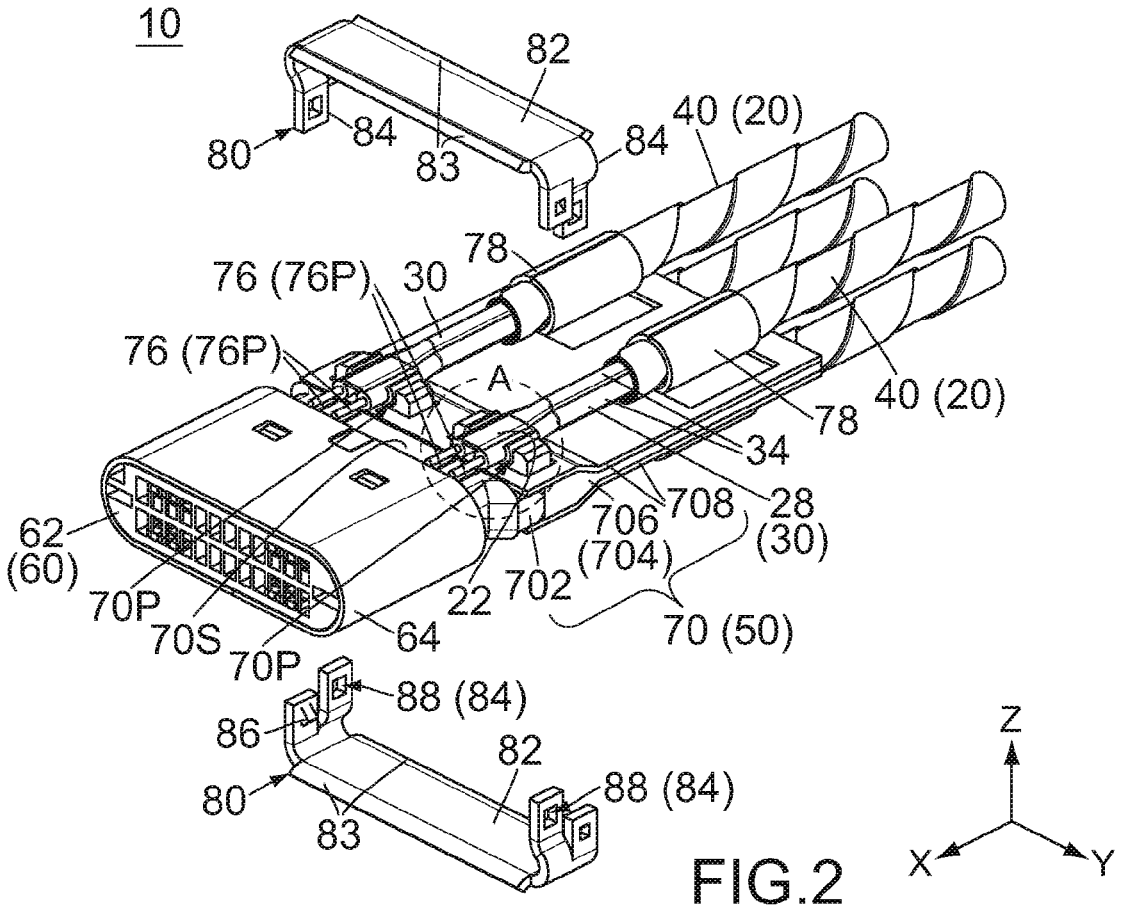
FIG. 2 is a perspective view showing the connection structure of FIG. 1, wherein pressure members of the connection object are detached.

As shown in FIGS. 1 and 2, a connection structure 10 according to an embodiment of the present invention comprises four cables 20 and a connection object 50. The cables 20 have structures same as one another and are connected to the connection object 50 in the same way. However, the present invention is not limited thereto. For example, the cables 20 may have structures different from one another. Moreover, the number of the cables 20 of the connection structure 10 may be one or more.

Hereafter, explanation will be made about the structure of one of the cables 20. The following explanation is applicable to each of the cables 20 according to the present embodiment.

The cable 20 of the present embodiment includes an inner member 30 and an outer member 40. The inner member 30 is an inner structure of the cable 20 and extends along an extending direction of the cable 20. The outer member 40 covers the inner member 30 in a cable cross-section perpendicular to the extending direction of the cable 20. The inner member 30 has an end that is exposed from the outer member 40.

Referring to FIG. 1, the outer member 40 of the present embodiment includes a shielding member 42 made of metal and a jacket 44 made of insulator. The shielding member 42 covers the inner member 30 in the cable cross-section. The jacket 44 covers the shielding member 42 in the cable cross-section. The shielding member 42 has an end that is folded back to be disposed on the jacket 44. However, the present invention is not limited thereto, but the structure of the outer member 40 can be modified variously as necessary.

Figure 3:
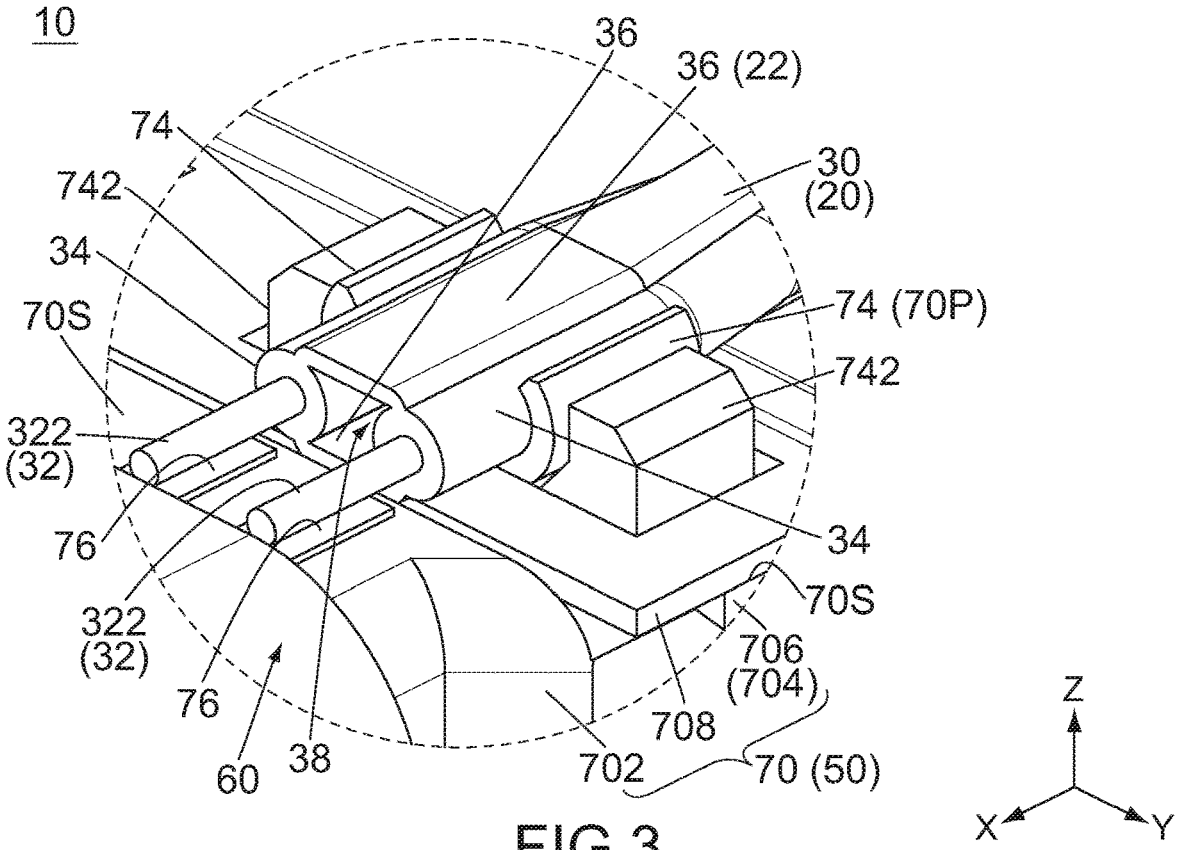
FIG. 3 is a perspective view showing a part of the connection structure of FIG. 2 enclosed by dashed line A.
Figure 5:
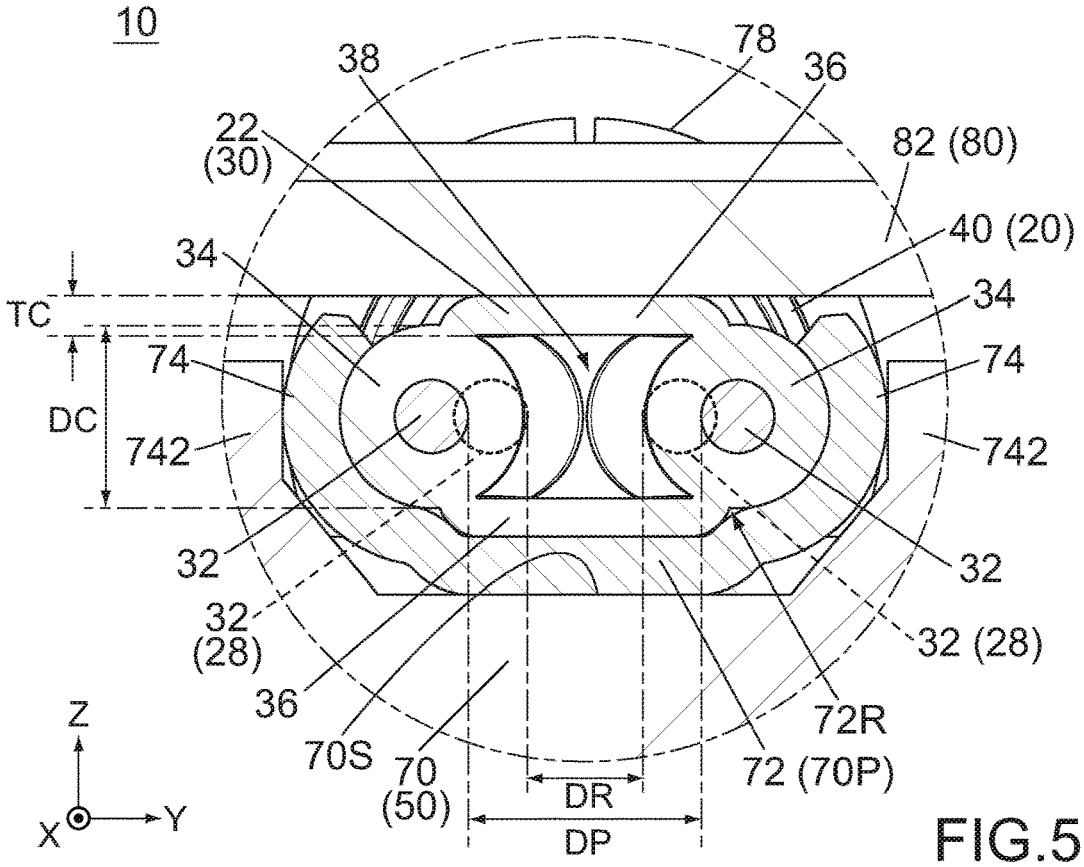
FIG. 5 is a cross-sectional view showing a part of the connection structure of FIG. 4 enclosed by chain dotted lines B, wherein positions of wires of a rear section of the cable are illustrated with dashed line.

Referring to FIGS. 3 and 5, the inner member 30 is formed of two wires 32 each made of conductor such as metal, two coverings 34 each made of insulator such as resin, two coupling strips 36 each made of insulator such as resin and a hollow 38. The coverings 34 correspond to the two wires 32, respectively. Thus, the cable 20 includes the two wires 32, the two coverings 34 corresponding to the wires 32, respectively, the two coupling strips 36 and the hollow 38. The cable 20 of the present embodiment includes only two of the wires 32. The two wires 32 work as a differential pair for transmitting differential signals. However, the present invention is not limited thereto. For example, the two wires 32 may be members for transmitting signals independent from each other.

Each of the wires 32 of the present embodiment is formed of a plurality of fine metal wires (not shown) which are spirally twisted and has a circular shape in the cable cross-section. However, the present invention is not limited thereto. For example, each of the wires 32 may be a single metal wire. The shape of the wire 32 in the cable cross-section is not specifically limited.

Each of the coverings 34 of the present embodiment covers the corresponding wire 32 in the cable cross-section and has an annular shape in the cable cross-section. Each of the wires 32 is located at the center of the corresponding covering 34 in the cable cross-section. Thus, each of the coverings 34 entirely covers the corresponding wire 32 in the cable cross-section. However, the present invention is not limited thereto. For example, the covering 34 may have an oval ring shape or the other shape in the cable cross-section.

Each of the coupling strips 36 couples the two coverings 34 to each other in the cable cross-section. Thus, the coverings 34 and the coupling strips 36 are coupled to one another to form a closed ring in the cable cross-section. The thus-coupled two coverings 34 enclose the hollow 38 together with the two coupling strips 36 in the cable cross-section while covering the two wires 32, respectively. In other words, the hollow 38 is a space enclosed by the coverings 34 and the coupling strips 36 in the cable cross-section.

Figure 7:
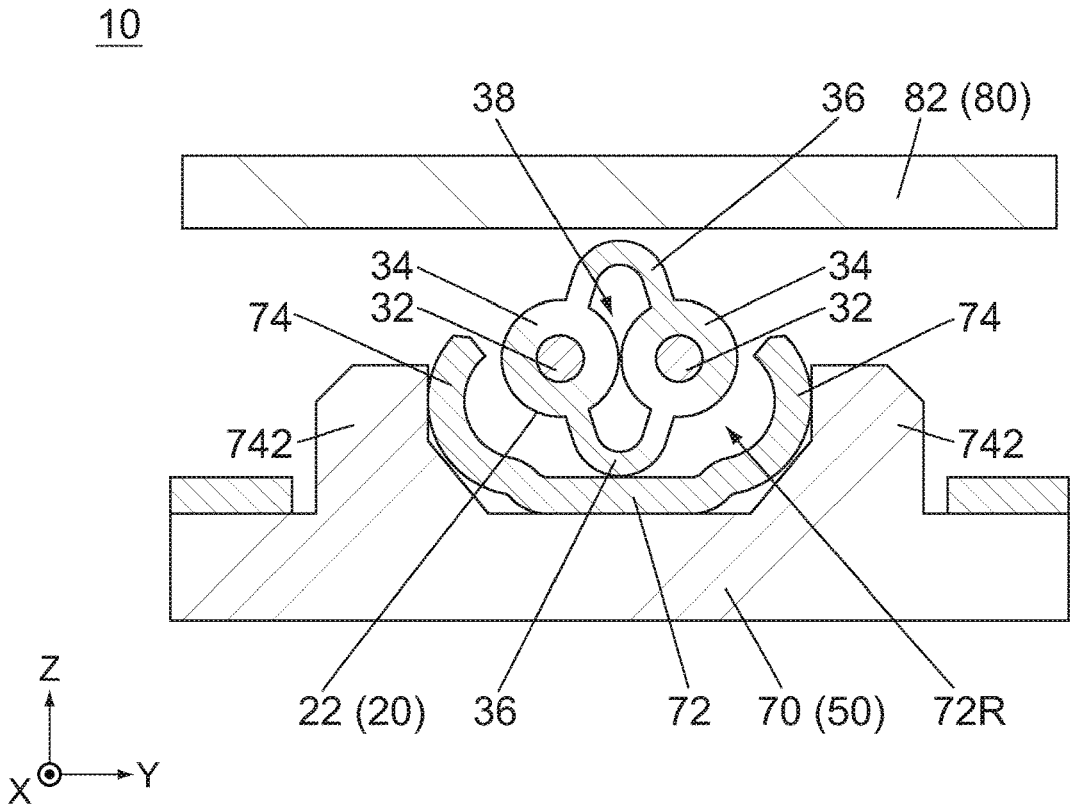
FIG. 7 is an end view showing a part of the connection structure of FIG. 4 enclosed by dashed line C, wherein the connection structure is under a state where an arrangement step of the forming method of FIG. 6 is ended.

Referring to FIG. 7, when the cable 20 is under an initial state in which no force is applied to the cable 20, each of the coupling strips 36 has a half-elliptical shape in the cable cross-section, and each of the coverings 34 protrudes into the hollow 38 and protrudes outward from the hollow 38. Under the initial state of the cable 20, the coverings 34 are close to or in contact with each other in a predetermined direction, or the Y-direction in FIG. 7. Under the initial state of the cable 20, the coupling strips 36 project from the coverings 34 in opposite directions each perpendicular to the predetermined direction, or the positive Z-direction and the negative Z-direction in FIG. 7. When the cable 20 is under the initial state, the coverings 34 are arranged in a lateral direction (Y-direction), and the cable 20 extends along a front-rear direction (X-direction) perpendicular to the Y-direction. Referring to FIGS. 7 to 10, when the cable 20 under the initial state is sandwiched and pressed in an upper-lower direction (Z-direction) perpendicular to both the X-direction and the Y-direction, the cable 20 is resiliently deformed.

Referring to FIG. 5, according to the present embodiment, a thickness dimension TC of the coupling strip 36 in the cable cross-section is one sixth or less than an outer diameter dimension DC of the covering 34 in the cable cross-section. According to these dimensions, the coupling strips 36 of the present embodiment can be easily deformed relative to the coverings 34. Referring to FIGS. 3 and 5 together with FIG. 7, according to this structure, each of the coupling strips 36 can be easily deformed without substantial deformation of each of the coverings 34 by sandwiching and pressing the cable 20 under the initial state in the Z-direction. In accordance with this deformation of the coupling strips 36, the cable 20 can be deformed so that the two wires 32 are away from each other in the Y-direction.

In detail, when the cable 20 is sandwiched and pressed vertically, each of the coupling strips 36 is easily deformed while each of the coverings 34 is hardly deformed. Each of the coupling strips 36 of the connection structure 10 is partially deformed as described above, so that a part thereof has a rectangular shape in parallel to a horizontal plane (XY-plane) in the cable cross-section. However, the present invention is not limited thereto. The shape of each of the coupling strips 36 is not limited to that of the present embodiment, provided that the coupling strips 36 are resiliently deformable relative to the coverings 34.

Hereafter, explanation will be made about the structure of the connection object 50.

Referring to FIGS. 1 and 2, the connection object 50 of the present embodiment comprises a connector 60, a base portion 70 and two pressing members 80. The base portion 70 is attached to a rear end (negative X-side end) of the connector 60. However, the present invention is not limited thereto. For example, the connection object 50 may comprise only the base portion 70 and the pressing members 80.

Referring to FIG. 2, the connector 60 of the present embodiment comprises a housing 62 made of insulator, a shell 64 made of metal and a plurality of terminals (not shown) each made of conductor. Each of the terminals is accommodated in the housing 62 and held by the housing 62. The shell 64 encloses the housing 62 in a perpendicular plane (YZ-plane) perpendicular to the X-direction. However, the present invention is not limited thereto, but the structure of the connector 60 can be modified variously as necessary.

The base portion 70 of the present embodiment comprises a first member 702 made of insulator and a second member 704. The first member 702 is attached to the rear end of the connector 60. The second member 704 is a member formed separately from the first member 702 and is attached to a rear end of the first member 702. However, the present invention is not limited thereto. For example, the first member 702 and the second member 704 may be a single member inseparable from each other. The base portion 70 may be a paddle attachable to a universal serial bus (USB) Type-C connector. Thus, the connector 60 may be compliant with USB TYPE-C standard.

The second member 704 of the present embodiment comprises a body portion 706 made of insulator and two plate-like portions 708 each formed of a metal plate. The body portion 706 has a flat plate-like shape in parallel to the XY-plane. One of the plate-like portions 708 is attached on an upper surface (positive Z-side surface) of the body portion 706 and covers the most part of the upper surface of the body portion 706. A remaining one of the plate-like portions 708 is attached on a lower surface (negative Z-side surface) of the body portion 706 and covers the most part of the lower surface of the body portion 706. The thus-provided plate-like portions 708 electromagnetically shield the inner member 30 exposed from the outer member 40 of the cable 20. However, the present invention is not limited thereto, but the plate-like portions 708 may be provided as necessary.

Figure 4:
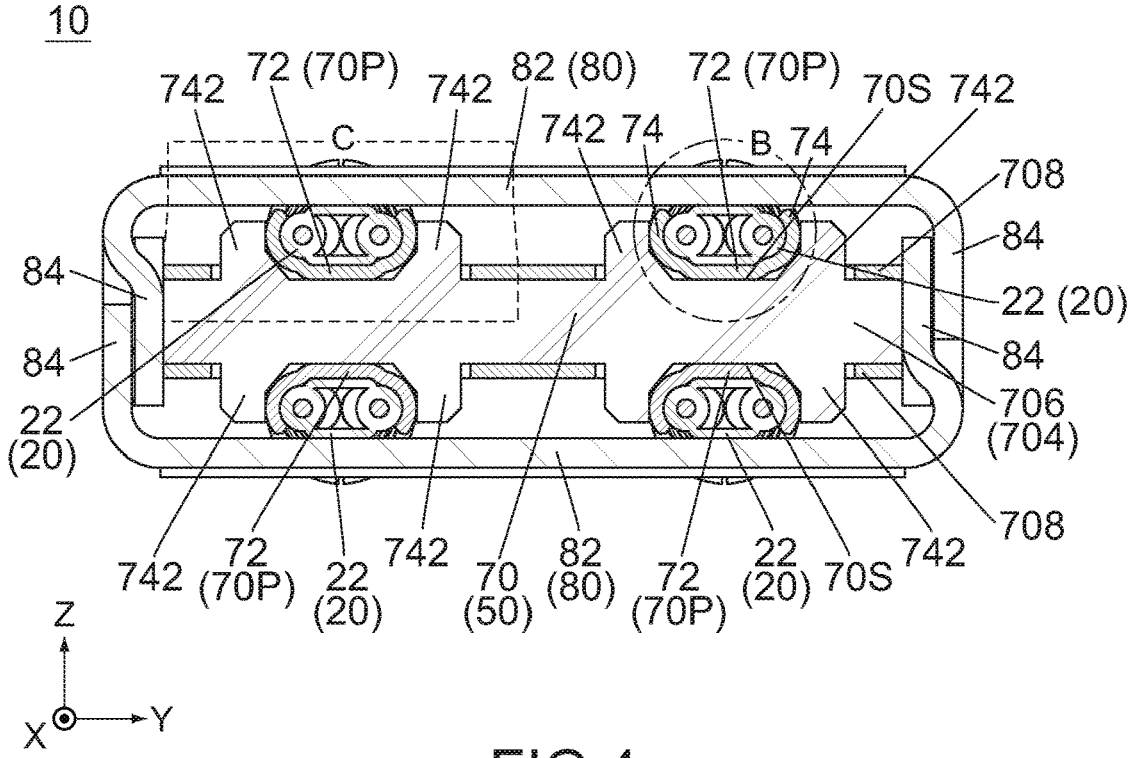
FIG. 4 is a cross-sectional view showing the connection structure of FIG. 1, taken along line IV-IV, wherein the line IV-IV is perpendicular to a front-rear direction and passes the middle of the pressing member in the front-rear direction.

Referring to FIGS. 2 to 4, according to the present embodiment, two of the cables 20 are attached to an upper side (positive Z-side) of the base portion 70, and the other two of the cables 20 are attached to a lower side (negative Z-side) of the base portion 70. Thus, the base portion 70 of the present embodiment has two attachment surfaces 70S to which the cables 20 are attached. One of the attachment surfaces 70S includes an upper surface of the first member 702 and the upper surface of the body portion 706 of the second member 704. A remaining one of the attachment surfaces 70S includes a lower surface of the first member 702 and the lower surface of the body portion 706 of the second member 704. However, the present invention is not limited thereto. For example, the base portion 70 may have only one of the attachment surfaces 70S. More specifically, the attachment surface 70S may be located only on the upper side of the base portion 70. In other words, the cables 20 may be attached only to the upper side of the base portion 70.

Referring to FIG. 2, each of the attachment surfaces 70S of the present embodiment is provided with two positioning mechanisms 70P, two pad pairs 76P and two cable-holding portions 78 for the two cables 20.

Referring to FIG. 4, the positioning mechanisms 70P have structures same as each other. The two positioning mechanisms 70P provided on one of the attachment surfaces 70S are arranged to be a mirror image of the other two positioning mechanisms 70P provided on a remaining one of the attachment surfaces 70S with respect to the XY-plane. Referring to FIG. 2, the pad pairs 76P have structures same as each other and are arranged mirror-symmetrically with respect to the XY-plane. The cable-holding portions 78 have structures same as each other and are arranged mirror-symmetrically with respect to the XY-plane. However, the present invention is not limited thereto. For example, each of the number of the positioning mechanisms 70P, the number of the pad pairs 76P and the number of the cable-holding portions 78 may be equal to the number of the cables 20 and thereby may be one or more. The arrangement of the positioning mechanisms 70P, the pad pairs 76P and the cable-holding portions 78 is not limited to that of the present embodiment but can be modified variously.

Hereafter, explanation will be made about one of the positioning mechanisms 70P, one of the pad pairs 76P and one of the cable-holding portions 78 for one of the cables 20. The following explanation is applicable to each of the positioning mechanisms 70P, the pad pairs 76P and the cable-holding portions 78 according to the present embodiment.

Referring to FIGS. 3 and 5, the positioning mechanism 70P of the present embodiment includes a catch portion 72, two side portions 74 and two reinforcement portions 742. Each of the pad pairs 76P of the present embodiment includes two pads 76. The two side portions 74 correspond to the coverings 34 of the cable 20, respectively. The two reinforcement portions 742 correspond to the two side portions 74, respectively. The two pads 76 correspond to the wires 32 of the cable 20, respectively. Referring to FIG. 2, the cable-holding portion 78 of the present embodiment is a part for holding the cable 20. As can be seen from the above description, for each of the cables 20, the base portion 70 of the present embodiment has the catch portion 72, the two side portions 74 corresponding to the coverings 34, respectively, the two reinforcement portions 742 corresponding to the side portions 74, respectively, the two pads 76 corresponding to the wires 32, respectively, and the cable-holding portion 78.

Referring to FIG. 4 together with FIG. 3, each of the catch portion 72 and the side portions 74 of the present embodiment is formed of a part of the plate-like portion 708 of the second member 704. In particular, each of the side portions 74 is partially cut off from the plate-like portion 708 and is then bent to be away from the attachment surface 70S. Each of the reinforcement portions 742 of the present embodiment is a part of the body portion 706 of the second member 704. Each of the reinforcement portions 742 extends through the cut-off part of the plate-like portion 708 to be away from the attachment surface 70S. According to the present embodiment, the catch portion 72, the side portions 74 and the reinforcement portions 742 can be provided without increasing the number of the members of the connection structure 10. However, the present invention is not limited thereto. For example, each of the catch portion 72, the side portions 74 and the reinforcement portions 742 may be a member formed separately from the second member 704. In another modification, a part of the attachment surface 70S may work as the catch portion 72.

Referring to FIG. 5, the catch portion 72 is provided on the attachment surface 70S and is located between the two side portions 74 in the Y-direction. Each of the side portions 74 extends to be away from the attachment surface 70S in the Z-direction. The catch portion 72 and the side portions 74 of the present embodiment are arranged in a line in the Y-direction. The thus-arranged positioning mechanism 70P is formed with a receiving space 72R. The receiving space 72R is a space enclosed by the catch portion 72 and the side portions 74 in the YZ-plane. However, the present invention is not limited thereto. For example, the catch portion 72 may be apart from the side portions 74 in the X-direction. The receiving space 72R according to this arrangement is a space located between the side portions 74 in the Y-direction.

Each of the side portions 74 of the present embodiment is bent in the YZ-plane so as to protrude outward in the Y-direction. Each of the thus-formed side portions 74 has a shape into which a part of the corresponding covering 34 of the cable 20 can be received. However, the present invention is not limited thereto. For example, each of the side portions 74 may linearly extend to be away from the attachment surface 70S in the Z-direction.

Referring to FIG. 3, the pads 76 correspond to the terminals (not shown) of the connector 60, respectively. Each of the pads 76 is provided on the attachment surface 70S and is connected to the corresponding terminal of the connector 60. The pads 76 are arranged in the Y-direction. Each of the pads 76 is located forward of the catch portion 72 (see FIG. 4) in the X-direction. In the present embodiment, the middle position between the two pads 76 in the Y-direction is matched with the middle position of the catch portion 72 in the Y-direction. Each of the thus-arranged pads 76 is provided on the attachment surface 70S of the first member 702. However, the present invention is not limited thereto. For example, each of the pads 76 may be provided on the attachment surface 70S of the second member 704.

Referring to FIG. 2 together with FIG. 5, the cable-holding portion 78 of the present embodiment is located rearward of the catch portion 72, or faces toward the negative X-side of the catch portion 72. The cable-holding portion 78 is formed of a part of the plate-like portion 708 of the second member 704. In detail, the cable-holding portion 78 is partially cut off from the plate-like portion 708 and is then bent to be away from the attachment surface 70S. However, the present invention is not limited thereto. For example, the cable-holding portion 78 may be a member formed separately from the second member 704.

The cable-holding portion 78 is crimped around the cable 20 and thereby holds the cable 20. The cable-holding portion 78 of the present embodiment is attached around the shielding member 42 of the cable 20 to be in contact with the shielding member 42. Thus, the shielding member 42 is grounded to the base portion 70. However, the present invention is not limited thereto. For example, the cable-holding portion 78 may be attached around the jacket 44 of the cable 20.

The cable-holding portion 78 of the present embodiment holds the outer member 40 of the cable 20 so that the two coverings 34 are arranged in the Y-direction. The middle position of the cable-holding portion 78 in the Y-direction is matched with the middle position of the catch portion 72 in the Y-direction. When the thus-arranged cable-holding portion 78 holds the cable 20, the middle position between the two coverings 34 of the cable 20 in the Y-direction is matched with the middle position of the catch portion 72 in the Y-direction. However, the present invention is not limited thereto. For example, the cable-holding portion 78 may hold the inner member 30 of the cable 20.

Hereafter, explanation will be made about the pressing members 80.

Referring to FIG. 2, the two pressing members 80 of the present embodiment have shapes same as each other. Each of the pressing members 80 is a single metal plate with bends and has a pressing portion 82, two protruding portions 83 and two arms 84.

The pressing portion 82 has a flat plate-like shape which extends in parallel to the XY-plane. The protruding portions 83 are located at opposite sides of the pressing portion 82 in the X-direction, respectively. Each of the protruding portions 83 extends along the pressing portion 82 in the Y-direction. Each of the protruding portions 83 protrudes outward in the X-direction from the pressing portion 82 while being away from the base portion 70 in the Z-direction. The arms 84 are located at opposite ends of the pressing portion 82 in the Y-direction, respectively. Each of the arms 84 extends from the pressing portion 82 toward the base portion 70 in the Z-direction. Each of the arms 84 is formed with an attachment projection 86 and an attachment hole 88. The attachment projection 86 projects inward in the Y-direction. The attachment hole 88 passes through the arm 84 in the Y-direction.

Referring to FIG. 2 together with FIG. 1, the two pressing members 80 of the present embodiment are attached to the base portion 70 so as to vertically sandwich the base portion 70. The attachment projection 86 of one of the pressing members 80 is received in the attachment projection 86 of a remaining one of the pressing members 80, so that the two pressing members 80 are coupled to each other while the pressing portion 82 presses a part of the inner member 30 of the cable 20 against the base portion 70. Each of the pressing members 80 of the present embodiment is attached to the base portion 70 without direct fixation thereof to the base portion 70. However, the present invention is not limited thereto. Neither the structure of the pressing member 80 nor the attachment method thereof to the base portion 70 is specifically limited, provided that the pressing member 80 can be attached to the base portion 70 so as to resiliently deform a part of the inner member 30. For example, each of the pressing members 80 may be directly fixed to the base portion 70.

Hereafter, explanation will be made about the function of one of the positioning mechanisms 70P for one of the cables 20. The following explanation is applicable to each of the positioning mechanisms 70P according to the present embodiment.

Referring to FIG. 1, the cable 20 has a pressed section 22. The pressed section 22 is a part of the inner member 30 of the cable 20. The pressed section 22 is pressed by the pressing portion 82 of the pressing member 80 toward the base portion 70 along the Z-direction to be resiliently deformed. In other words, the pressed section 22 is a part of the cable 20 which is sandwiched and pressed between the pressing portion 82 and the base portion 70 in the Z-direction. Referring to FIGS. 3 and 5, the pressed section 22 of the present embodiment is partially located at a position same as that of the side portions 74 in the X-direction. However, the present invention is not limited thereto. For example, the pressed section 22 may be entirely located at a position same as that of the side portions 74 in the X-direction.

Referring to FIG. 5, the pressing portion 82 of the pressing member 80 presses the pressed section 22 against the catch portion 72 in the Z-direction. Thus, the pressed section 22 is sandwiched and pressed between the pressing member 80 and the catch portion 72 in the Z-direction. The thus-sandwiched pressed section 22 is located between the two side portions 74 in the Y-direction. The two coverings 34 of the pressed section 22 are arranged in the Y-direction. The two coupling strips 36 of the pressed section 22 are arranged in the Z-direction.

Figure 8:
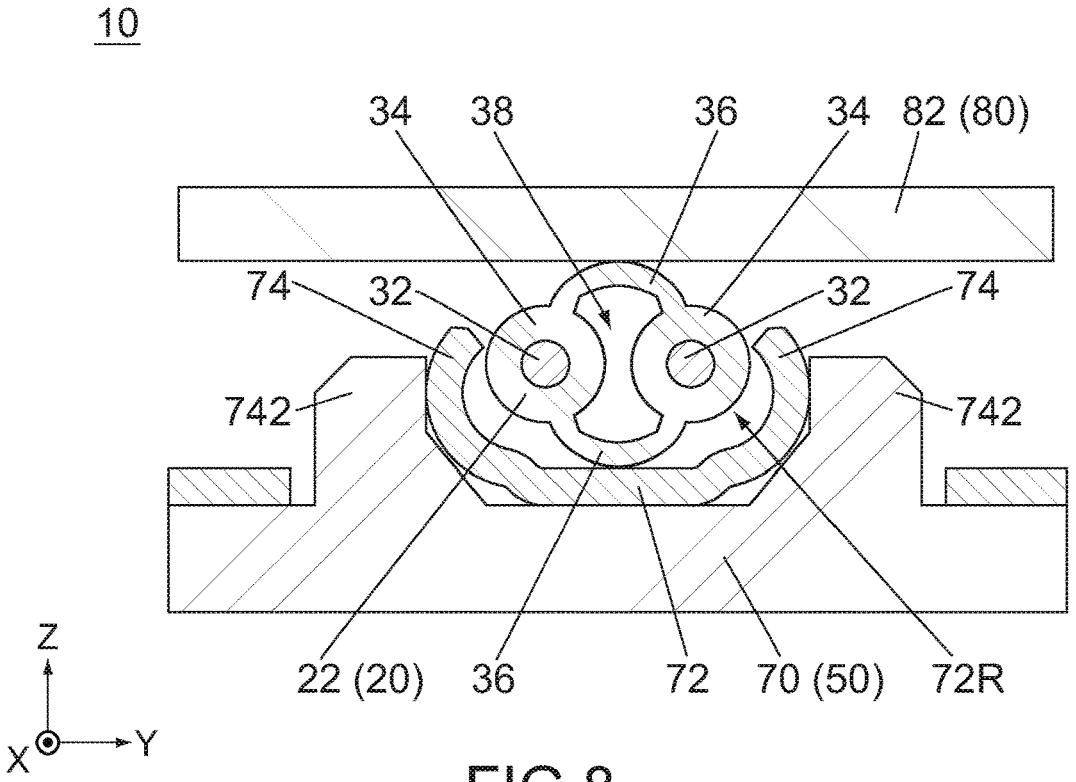
FIG. 8 is an end view showing the connection structure of FIG. 7, wherein the connection structure is under a state where an attachment step of the forming method of FIG. 6 is started.
Figure 9:
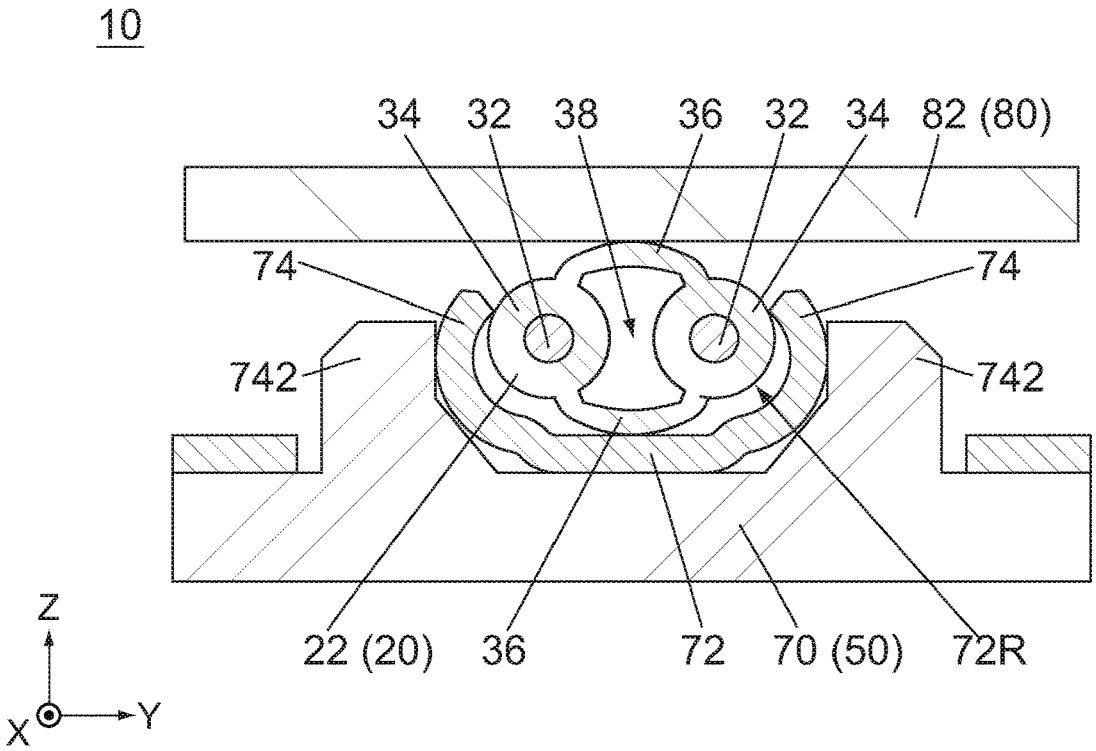
FIG. 9 is an end view showing the connection structure of FIG. 7, wherein the connection structure is under a state where the attachment step is performed.
Figure 10:
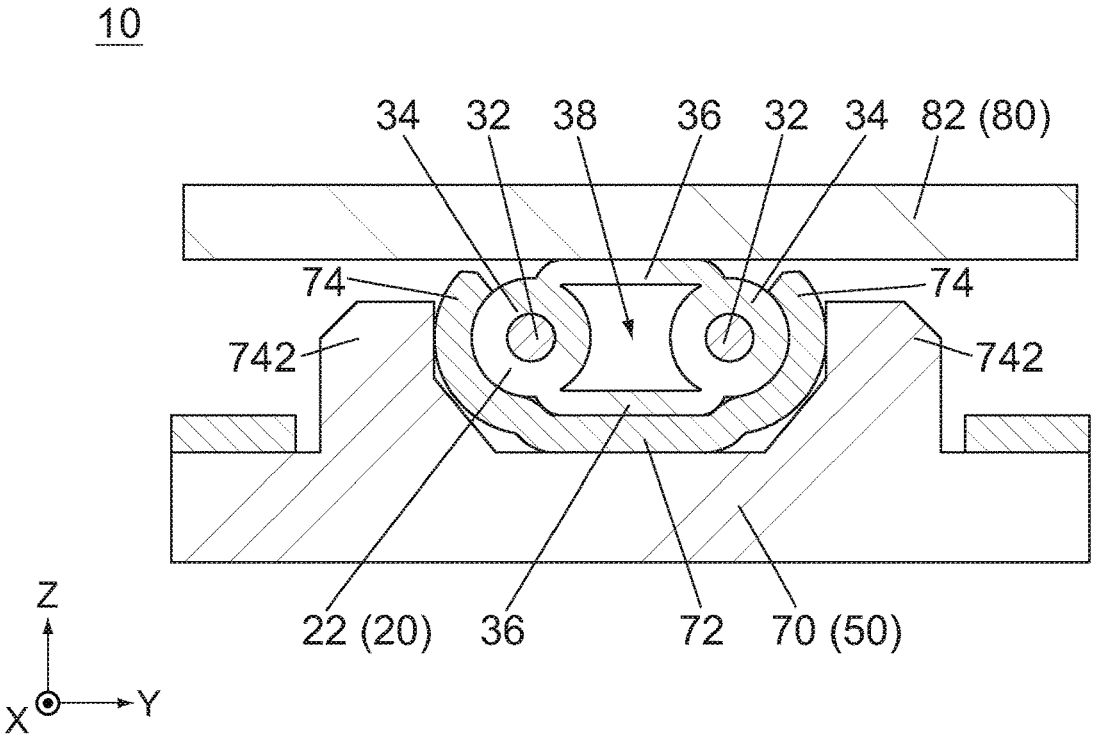
FIG. 10 is an end view showing the connection structure of FIG. 7, wherein the connection structure is under a state where the attachment step is ended.
Figure 11:
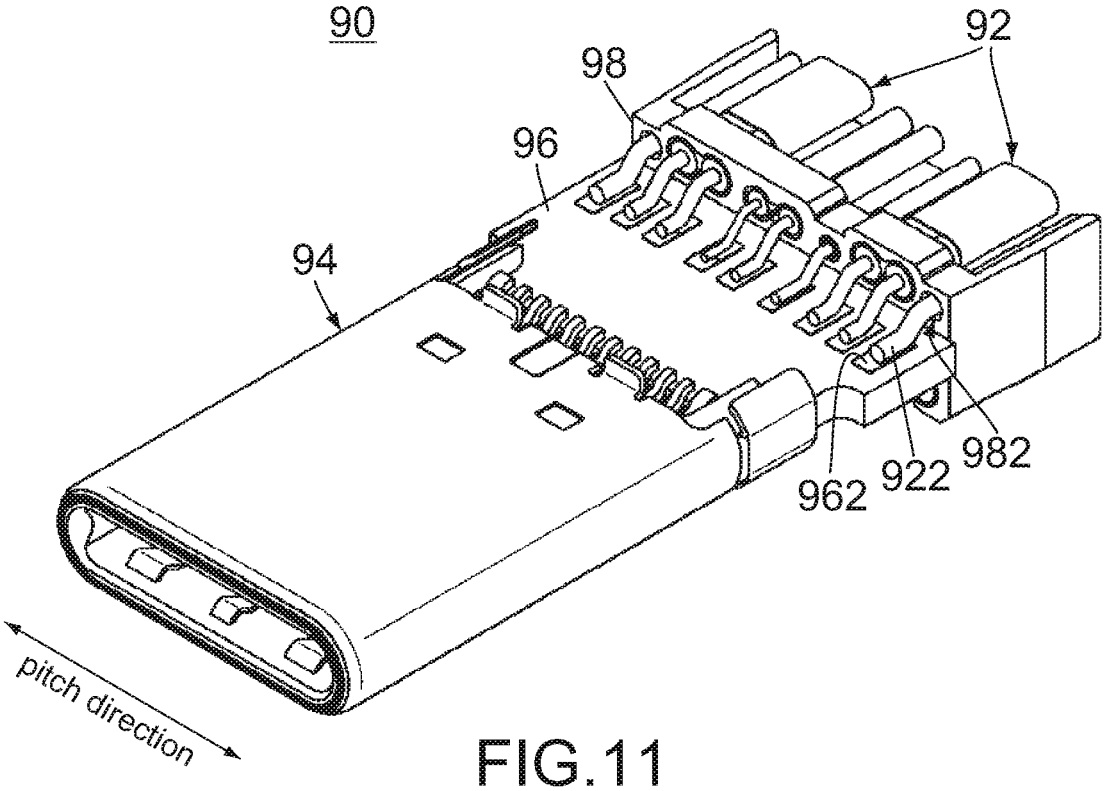
FIG.11 PRIOR ART
FIG. 11 is a perspective view showing a connection structure of Patent Document 1.

Referring to FIGS. 8 to 10, when the pressed section 22 is pressed against the catch portion 72, the coupling strips 36 of the pressed section 22, which are arranged as described above, are resiliently deformed. In detail, a part of one of the coupling strips 36 of the pressed portion, which is located at the middle of the coupling strip 36 in the Y-direction, is pressed against the catch portion 72. A friction force generated between the thus-pressed part of the coupling strip 36 and the catch portion 72 prevents a movement of the pressed part in the XY-plane. As a result, each of the coupling strips 36 is resiliently deformed relative to the pressed portion so as to be spread in opposite directions in the Y-direction. Thus, the coverings 34 are moved to be away from each other in the Y-direction. When the attachment of the pressing member 80 to the base portion 70 is ended, the aforementioned deformation is ended. As a result of the aforementioned deformation, one of the coupling strips 36 of the pressed section 22 is in contact with the pressing portion 82 of the pressing member 80, and a remaining one of the coupling strips 36 of the pressed section 22 is in contact with the catch portion 72.

Referring to FIG. 5, as a result of the aforementioned deformation according to the present embodiment, each of the coverings 34 of the pressed section 22 is pressed against the corresponding side portion 74 to be in contact with the corresponding side portion 74. When the coverings 34 are arranged as described above, each of the wires 32 is located at a position same as that of the corresponding pad 76 in the Y-direction. Thus, the two wires 32 are simultaneously positioned to each other in the Y-direction. However, the present invention is not limited thereto. For example, only one of the coverings 34 of the pressed section 22 may be in contact with the corresponding side portion 74. Thus, at least one of the coverings 34 of the pressed section 22 may be in contact with the corresponding side portion 74.

According to the present embodiment, when a part of the cable 20, namely the pressed section 22, is located between the two side portions 74 and is resiliently deformed as described above, at least one of the coverings 34 can be pressed against the corresponding side portion 74. As a result, the two wires 32 can be simultaneously positioned in the Y-direction. As described above, according to the present embodiment, the wires 32 can be positioned in the Y-direction only by arranging the pressed section 22 of the cable 20 between the two side portions 74 and by pressing the thus-arranged pressed section 22. Thus, the present embodiment provides the connection structure 10 with a structure that enables easy positioning of the wires 32.

Referring to FIG. 3, each of the wires 32 has an exposed portion 322 exposed from the covering 34. Each of the exposed portions 322 is positioned as described above and is then fixed on and connected to the corresponding pad 76 via soldering, etc. As a result, each of the wires 32 is electrically connected with the corresponding terminal (not shown) of the connector 60 via the corresponding pad 76.

Referring to FIG. 2, the cable 20 has a rear section 28. The rear section 28 is a part of the inner member 30 of the cable 20 which is located rearward of the pressed section 22. The rear section 28 is located rearward of the pressing member 80 and does not directly receive the force applied from the pressing member 80. Therefore, the rear section 28 is hardly deformed. Referring to FIG. 5, in the Y-direction, a distance between the two wires 32 of the pressed section 22 is longer than another distance between the two wires 32 of the rear section 28.

Referring to FIG. 2, when the cable 20 of the present embodiment is seen along the Z-direction, the two coverings 34 extend between the pressed section 22 and the rear section 28 with no intersection with each other. In other words, the inner member 30 of the cable 20 is not twisted while extending along the X-direction. The inner member 30 of the present embodiment has a structure that is hard to be twisted. However, from a view point of more secure prevention of a twist of the inner member 30, a recess may be formed between the cable-holding portion 78 and the catch portion 72 in the X-direction in order to receive the projection of the coupling strip 36 (see FIG. 7) of the inner member 30.

Referring to FIG. 2, each of the pressing members 80 has the protruding portions 83 which slopes to be away from the pressed section 22 of the cable 20. The protruding portions 83 strengthen the pressing member 80. Each of the pressing members 80 is hard to be bent since being provided with the protruding portions 83. In addition, since the protruding portions 83 are provided as described above, the pressed section 22 can be pressed by each of the pressing members 80 with no damage. For example, even in a case where each of the pressing members 80 presses three or more of the cables 20 arranged in the Y-direction, the pressed sections 22 can be pressed by forces same as one another. However, the present invention is not limited thereto. For example, the protruding portions 83 may be provided as necessary. The structure for strengthening the pressed section 22 is not limited to the protruding portions 83 of the present embodiment but can be modified variously.

Referring to FIGS. 4 and 5, each of the reinforcement portions 742 of the present embodiment is located outward of the corresponding side portion 74 in the Y-direction and is partially in contact with the corresponding side portion 74. Referring to FIG. 5, each of the side portions 74 of the present embodiment is reinforced by the reinforcement portion 742. Each of the thus-reinforced side portions 74 securely receive and position the corresponding covering 34 when the corresponding covering 34 is pressed against the side portion 74. However, the present invention is not limited thereto, but the reinforcement portions 742 may be provided as necessary.

Hereafter, explanation will be made about an example of forming method which forms the connection structure 10 comprising the cables 20 and the connection object 50.

Figure 6:
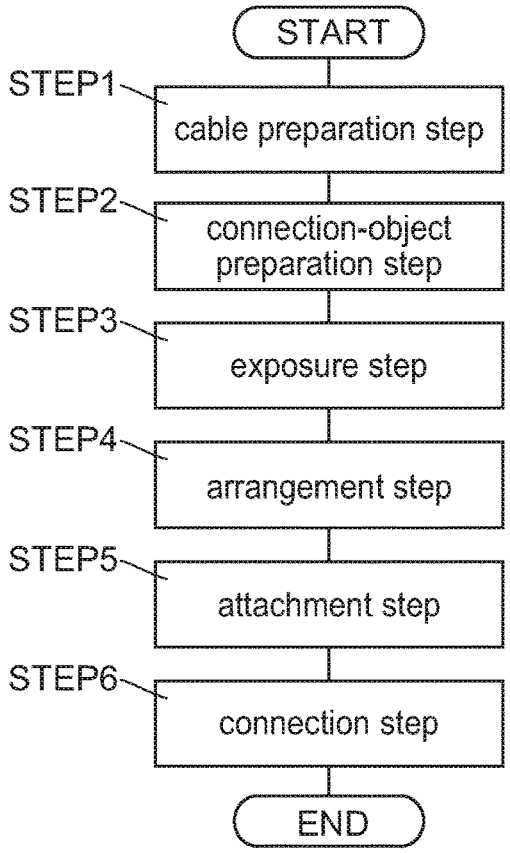
FIG. 6 is a flowchart showing an example of a forming method for forming the connection structure of FIG. 1.

Referring to FIG. 6, the forming method of the present embodiment comprises at least six steps, namely a cable preparation step (STEP 1), a connection-object preparation step (STEP 2), an exposure step (STEP 3), an arrangement step (STEP 4), an attachment step (STEP 5) and a connection step (STEP 6). Hereafter, explanation will be made about the forming method of the present embodiment along starting order of these steps.

Referring to FIG. 2, in the first step, or in the cable preparation step (see FIG. 6), a necessary number of the cables 20 each having the previously described structure is prepared. Thus, referring to FIG. 3, the forming method of the present embodiment comprises preparing the cable 20, the cable 20 comprising the two wires 32, the two coverings 34, the two coupling strips 36 and the hollow 38, the coverings 34 corresponding to the wires 32, respectively, each of the coverings 34 covering the corresponding wire 32, each of the coupling strips 36 coupling the two coverings 34 to each other in the cable cross-section perpendicular to the extending direction of the cable 20, the hollow 38 being a space enclosed by the coverings 34 and the coupling strips 36 in the cable cross-section.

Referring to FIG. 2, in the next step, or in the connection-object preparation step (see FIG. 6), the connection object 50 having the previously described structure is prepared. Thus, referring to FIG. 2 together with FIG. 5, the forming method of the present embodiment comprises preparing the connection object 50, the connection object 50 comprising the base portion 70 and the pressing member 80, the base portion 70 having the attachment surface 70S, the catch portion 72, the two side portions 74 and the two pads 76, the two side portions 74 corresponding to the coverings 34, respectively, the pads 76 corresponding to the wires 32, respectively, the catch portion 72 being provided on the attachment surface 70S and being located between the two side portions 74 in the Y-direction, each of the side portions 74 extending to be away from the attachment surface 70S in the Z-direction, each of the pads 76 being provided on the attachment surface 70S and being located forward of the catch portion 72 in the X-direction.

Referring to FIG. 3, in the next step, or in the exposure step (see FIG. 6), a front end (positive X-side end) of the outer member 40 of the cable 20 is removed, so that a front end of the inner member 30 is exposed. The coverings 34 of the thus-exposed front end are partially removed via laser processing, for example, so that the wires 32 are partially exposed. Thus, the forming method of the present embodiment comprises forming the exposed portion 322 of each of the wires 32, the exposed portion 322 being exposed from the covering 34. According to the exposure step of the present embodiment, a front end of the wire 32 is exposed. However, the present invention is not limited thereto. For example, the wire 32 may be partially exposed while a front end of the covering 34 is not removed.

Referring to FIG. 7 together with FIG. 3, in the next step, or in the arrangement step (see FIG. 6), the pressed section 22 of the cable 20, which is located rearward of the exposed portions 322, is partially arranged in the receiving space 72R enclosed by the catch portion 72 and the side portions 74. Meanwhile, each of the exposed portions 322 is arranged in the vicinity of the corresponding pad 76. For example, each of the exposed portions 322 is arranged inward of the corresponding pad 76 in the Y-direction. Instead, each of the exposed portions 322 may be arranged to face, at least in part, the corresponding pad 76 in the Z-direction. In other words, each of the exposed portions 322 is arranged so that a position of each of the exposed portions 322 in the X-direction is, at least in part, overlapped with another position of the corresponding pad 76 in the X-direction. Thus, the forming method of the present embodiment comprises arranging the exposed portions 322 of the cable 20 and the pressed section 22 of the cable 20 which is located rearward of the exposed portions 322, the arranged pressed section 22 being located in the space enclosed by the catch portion 72 and the side portions 74, each of the arranged exposed portions 322 being located, at least in part, at a position same as that of the corresponding pad 76 in the X-direction.

Referring to FIG. 2, according to the arrangement step of the present embodiment, the cable 20 is held by the cable-holding portion 78 before or after the pressed section 22 is arranged in the receiving space 72R. As previously described, the two coverings 34 of the thus-held cable 20 are arranged in the Y-direction. However, the present invention is not limited thereto, but the step in which the cable 20 is held by the cable-holding portion 78 may be performed as necessary.

Referring to FIGS. 8 and 9, in the next step, or in the attachment step (see FIG. 6), the pressing members 80 are attached to the base portion 70 as previously described. Thus, the forming method of the present embodiment comprises attaching the pressing member 80 to the base portion 70 to sandwich and press the pressed section 22 of the cable 20 between the pressing member 80 and the catch portion 72 in the Z-direction, the sandwiched pressed section 22 being resiliently deformed so that the two wire 32 are away from each other in the Y-direction, the resiliently deformed pressed section 22 being pressed against at least one of the side portions 74 in the Y-direction.

Referring to FIG. 10, as previously described, when the attachment step is ended, one of the coupling strips 36 of the pressed section 22 is in contact with the pressing member 80, and a remaining one of the coupling strips 36 of the pressed section 22 is in contact with the catch portion 72. In addition, at least one of the coverings 34 of the pressed section 22 is in contact with the corresponding side portion 74. Referring to FIG. 3, as previously described, when the attachment step is ended, each of the wires 32 is located at a position same as that of the corresponding pad 76 in the Y-direction. In detail, each of the wires 32 faces the corresponding pad 76 in the Z-direction or is in contact with the corresponding pad 76.

Referring to FIG. 3, in the next step, or in the connection step (see FIG. 6), each of the exposed portions 322 is fixed on and connected to the corresponding pad 76 via soldering, etc. As a result, each of the wires 32 is electrically connected with the corresponding terminal (not shown) of the connector 60 via the corresponding pad 76. Thus, the forming method of the present embodiment comprises connecting each of the exposed portions 322 to the corresponding pad 76 after the attaching the pressing member 80 to the base portion 70.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connection structure comprising a cable and a connection object, wherein:

the cable includes two wires, two coverings, two coupling strips and a hollow;

the coverings correspond to the wires, respectively;

each of the coverings covers a corresponding one of the wires;

each of the coupling strips couples the two coverings to each other in a cable cross-section perpendicular to an extending direction of the cable;

the hollow is a space enclosed by the coverings and the coupling strips in the cable cross-section;

the connection object comprises a base portion and a pressing member;

the base portion has an attachment surface, a catch portion, two side portions and two pads;

the side portions correspond to the coverings, respectively;

the pads correspond to the wires, respectively;

the catch portion is provided on the attachment surface and is located between the two side portions in a lateral direction;

each of the side portions extends to be away from the attachment surface in an upper-lower direction perpendicular to the lateral direction;

each of the pads is provided on the attachment surface and is located forward of the catch portion in a front-rear direction perpendicular to both the lateral direction and the upper-lower direction;

the pressing member is attached to the base portion;

the cable has a pressed section;

the pressed section is sandwiched and pressed between the pressing member and the catch portion in the upper-lower direction and is located between the two side portions in the lateral direction;

one of the coupling strips of the pressed section is in contact with the pressing member, a remaining one of the coupling strips of the pressed section is in contact with the catch portion, and at least one of the coverings of the pressed section is in contact with a corresponding one of the side portions;

each of the wires has an exposed portion exposed from the covering;

each of the exposed portions is connected to a corresponding one of the pads;

the cable has a rear section;

the rear section is located rearward of the pressing member; and in the lateral direction, a distance between the two wires of the pressed section is longer than another distance between the two wires of the rear section.

2. The connection structure as recited in claim 1, wherein:

the base portion has a cable-holding portion; and the cable-holding portion is located rearward of the catch portion and holds the cable.

3. The connection structure as recited in claim 1, wherein when the cable is seen along the upper-lower direction, the two coverings extend between the pressed section and the rear section with no intersection with each other.

4. A forming method of a connection structure, the connection structure comprising a cable and a connection object, the forming method comprising:

preparing the cable, the cable including two wires, two coverings, two coupling strips and a hollow, the coverings corresponding to the wires, respectively, each of the coverings covering a corresponding one of the wires, each of the coupling strips coupling the two coverings to each other in a cable cross-section perpendicular to an extending direction of the cable, the hollow being a space enclosed by the coverings and the coupling strips in the cable cross-section;

preparing the connection object, the connection object comprising a base portion and a pressing member, the base portion having an attachment surface, a catch portion, two side portions and two pads, the side portions corresponding to the coverings, respectively, the pads corresponding to the wires, respectively, the catch portion being provided on the attachment surface and being located between the two side portions in a lateral direction, each of the side portions extending to be away from the attachment surface in an upper-lower direction perpendicular to the lateral direction, each of the pads being provided on the attachment surface and being located forward of the catch portion in a front-rear direction perpendicular to both the lateral direction and the upper-lower direction;

forming an exposed portion of each of the wires, the exposed portion being exposed from the covering;

arranging the exposed portions of the cable and a pressed section of the cable which is located rearward of the exposed portions, the arranged pressed section being located in a space enclosed by the catch portion and the side portions, each of the arranged exposed portions being located, at least in part, at a position same as that of a corresponding one of the pads in the front-rear direction; and attaching the pressing member to the base portion to sandwich and press the pressed section between the pressing member and the catch portion in the upper-lower direction, the sandwiched pressed section being resiliently deformed so that the two wires are away from each other in the lateral direction, the resiliently deformed pressed section being pressed against at least one of the side portions in the lateral direction, wherein when the attaching is ended, one of the coupling strips of the pressed section is in contact with the pressing member, a remaining one of the coupling strips of the pressed section is in contact with the catch portion, and at least one of the coverings of the pressed section is in contact with a corresponding one of the side portions.

5. The forming method as recited in claim 4, wherein:

the base portion has a cable-holding portion;

the cable-holding portion is located rearward of the catch portion; and in the arranging, the cable is held by the cable-holding portion.

6. The forming method as recited in claim 4, the forming method comprising connecting each of the exposed portions to a corresponding one of the pads after the attaching.

7. A cable including two wires, two coverings, two coupling strips and a hollow, wherein:

the coverings correspond to the wires, respectively;

each of the coverings covers a corresponding one of the wires;

each of the coupling strips couples the two coverings to each other in a cable cross-section perpendicular to an extending direction of the cable; and the hollow is a space enclosed by the coverings and the coupling strips in the cable cross-section.

8. The cable as recited in claim 7, wherein:

the coverings are close to or in contact with each other in a predetermined direction; and the coupling strips project from the coverings in opposite directions each perpendicular to the predetermined direction.

* * * * *